US006606756B2

(12) United States Patent
Fernandez

(10) Patent No.: US 6,606,756 B2
(45) Date of Patent: Aug. 19, 2003

(54) BROOM WITH VARIABLE STIFFNESS BRISTLES AND BRISTLE CLEANING DEVICE

(75) Inventor: Juan Fernandez, Ridgefield Park, NJ (US)

(73) Assignee: Products of Tomorrow, Inc., Towaco, NJ (US)

( * ) Notice: Subject to any disclaimer, the term of this patent is extended or adjusted under 35 U.S.C. 154(b) by 6 days.

(21) Appl. No.: 09/852,946

(22) Filed: May 10, 2001

(65) Prior Publication Data

US 2002/0166186 A1 Nov. 14, 2002

(51) Int. Cl.[7] ..... A46B 17/06; A47L 13/12

(52) U.S. Cl. ..... 15/111; 15/106; 15/114; 15/169

(58) Field of Search ..... 15/169, 184, 106, 15/111, 114, 115, 142, 246

(56) References Cited

U.S. PATENT DOCUMENTS

| | | | | | |
|---|---|---|---|---|---|
| 1,303,500 | A | | 5/1919 | Rosenberg | 15/246 |
| 1,372,014 | A | | 3/1921 | Entwistle | 15/169 |
| 1,627,634 | A | * | 5/1927 | Coyne | 15/169 |
| 1,971,175 | A | * | 8/1934 | Diepold | 15/169 |
| 2,529,927 | A | | 11/1950 | Fisk | 15/159.1 |
| 2,740,146 | A | | 4/1956 | Vaughn | 15/119.2 |
| 3,108,305 | A | | 10/1963 | Peilet | 15/169 |
| 3,733,636 | A | * | 5/1973 | Osadsky | 15/111 |
| 3,737,936 | A | * | 6/1973 | Uosaki | 15/169 |
| 3,795,024 | A | * | 3/1974 | Weihrauch | 15/169 |
| 4,225,997 | A | * | 10/1980 | Thomas et al. | 15/184 |
| 4,864,675 | A | | 9/1989 | Jones | 15/119.2 |
| 5,381,579 | A | | 1/1995 | Sartori | 15/119.2 |
| 5,488,750 | A | | 2/1996 | Vosbikian et al. | 15/119.2 |
| 5,533,226 | A | | 7/1996 | Brown, Jr. | 15/119.2 |
| 5,802,657 | A | * | 9/1998 | Nogues et al. | 15/142 |
| 5,926,902 | A | * | 7/1999 | Pierre | 15/169 |
| 6,000,087 | A | | 12/1999 | Petner | 15/119.2 |
| RE36,635 | E | | 4/2000 | Vosbikian et al. | 15/119.2 |
| 6,112,359 | A | | 9/2000 | Kaleta | 15/142 |

FOREIGN PATENT DOCUMENTS

| | | | | |
|---|---|---|---|---|
| FR | 1225829 | * | 2/1960 | 15/169 |
| GB | 2151467 | * | 7/1985 | 15/169 |

* cited by examiner

*Primary Examiner*—Mark Spisich
(74) *Attorney, Agent, or Firm*—Lerner, David, Littenberg, Krumholz & Mentlik, LLP

(57) ABSTRACT

A broom for cleaning surfaces or floors is designed with a device having a plurality of narrow slots through which the bristles of the broom are threaded. The device is able to slide along the handle of the broom such that the span of the bristles projected from the slots of the device can increase or decrease. When the span of the bristles increases, the bristles are less stiff and the broom is suitable for gentle brushing action. As the span of the bristles decreases, the bristles stiffen, allowing the broom to be used for heavier brushing action. The device can also be set in a position such that the working ends or free ends of the bristles are completely sunk inside the slots. At this position, any dirt and dust that is trapped between the bristles will be pushed away from the bristles.

20 Claims, 6 Drawing Sheets

BROOM WITH VARIABLE STIFFNESS BRISTLES AND BRISTLE CLEANING DEVICE

BACKGROUND OF THE INVENTION

The invention relates generally to floor cleaning devices, and more particularly to a hand held broom having a device capable of varying the stiffness of the bristles, of cleaning of the bristles of the broom, and of placing a secondary cleaning implement in place beyond said bristles for more effective cleaning action.

Brooms of different configurations are well-known. Generally, they are designed with a plurality of bristles, with one end of the bristles attaching to an end of a handle and another end of the bristles free and acting as the sweeping or cleaning media. There are many kinds of natural and synthetic materials used as bristles for the broom, and the size of the bristles varies from one type of design to another. It is obvious that for different floor surfaces to be cleaned, cleaning can be more effective when bristles of the right stiffness are used. For instance, brooms with stiffer bristles will be more efficient for the cleaning of carpeted floor while those brooms with softer bristles will be more suitable for the sweeping of polished floor. Consequently, unless there are some means of varying the stiffness of the bristles of a broom, the users either have to use brooms of different bristle stiffness for different types of floors, or they have to tolerate the ineffectiveness of using brooms that have inadequate bristle stiffness.

Cleaning the bristles of a broom is also an unpleasant task for users. Dirt and dust trapped between the bristles often have to be pulled out by the user's bare hands, if they cannot be shaken off easily. Not only is this way of cleaning the broom unsanitary, but it can also be unsafe as sharp objects such as broken glass, staples or nails can be entrapped between the bristles.

The present invention also provides for the effective cleaning of the bristles, as well as providing for the adjustment of the stiffness of the bristles of the broom. Still further, the present invention provides a secondary cleaning implement, in addition to broom bristles, that can be arranged in an effective cleaning position.

SUMMARY OF THE INVENTION

The broom in accordance with the present invention preferably includes a handle having a longitudinal axis, a broom head having a substrate and a plurality of bristles with ends attached to said substrate and free ends for cleaning, a bristle plate having openings through which the bristles can extend, and a bristle plate actuator disposed for movement with respect to said handle so that movement of said actuator causes the bristle plate to move downward along the bristles from the attached ends to the free ends, and a lock associated with the handle so that the downward movement of the bristle plate is limited at a point intermediate the attached ends and the free ends of the bristles.

In another aspect of the present invention, the actuator may be locked so that the bristle plate is at a fully retracted position at which the bristle plate is adjacent the attached ends of the bristles, and also may be locked at an intermediate position, at which the bristle plate is intermediate the attached ends and free ends of the bristles, and also may be locked at a fully extended position, at which the bristle plate is adjacent or past the free ends of the bristles. More than one locked position intermediate the attached ends and free ends of the bristles may be provided.

Preferably, the locking may occur by reason of a stop associated with the handle, the stop riding within a longitudinal slot in a sleeve of a bristle plate actuator, the sleeve also carrying locking openings coextensive with the longitudinal slot in order to provide various locking positions, the sleeve being rotatable at least to the extent that the stop associated with the handle can be situated within a locking opening upon slight rotation of the sleeve.

The openings in the bristle plate can be defined by slots, and preferably, the slots are formed by a plurality of tines extending transversely to the longitudinal axis of the handle. Preferably, the tines are provided from two housing parts, and once the tines of the two parts are meshed to define the slots, the bristle plate is defined thereby. The bristle plate, whether in two parts or not, may completely bound the bristles within the slots or other openings, and may be provided in this arrangement around the bristles upon connection of the housing and actuator to the broom handle and head. In other words, the bristles may always extend through the openings of the bristle plate and are completely bounded thereby. The bristle plate could also be normally in an arrangement by which the bristles extend through the openings or by which the bristles are not only extending through the openings but are also bounded by a portion of the bristle plate. This avoids the need to engage the bristles with a bristle plate in order to effect the stiffening or cleaning action, and also avoids the bristles being open on one side or any sides, instead being bounded by the bristle plate.

In yet another aspect of the present invention, the present invention may include a secondary cleaning implement in addition to the bristles. The secondary cleaning implement may be associated with the lower portion of the handle in various locations, but is preferably associated with an actuator so that the secondary cleaning implement can be moved downward below the free ends of the bristles for a more effective cleaning action. It is to be understood that the phrase "below the free ends" of the bristles may be construed herein as meaning below or substantially at the same level as the free ends of the bristles, the ultimate goal being to provide an effective cleaning action by the secondary cleaning implement, or to fully clean the bristles.

In another aspect of the present invention, the secondary cleaning implement may be a scraper for scraping dirt or may be an abrasive pad for scrubbing dirt. Other conventional secondary cleaning implements are also contemplated herein.

In yet another aspect of the present invention, the broom in accordance with the present invention preferably includes a handle, a broom head at the lower portion of the handle, a plurality of bristles attached to the broom head, a bristle plate normally disposed adjacent the substrate, there being openings in the bristle plate through which the plurality of bristles normally extend, and a bristle plate actuator disposed for movement with respect to the handle, such that movement of the bristle plate actuator causes the bristle plate to move downward along the bristles from the attached ends to the free ends of the bristles in order to clean the bristles. In another aspect of the present invention, the above broom may be constructed so that the bristles are bounded by the bristle plate, by the openings, which may in a preferred embodiment be slots, as well as by a peripheral member, which may be described as a wall or rim.

In still a further aspect of the present invention, a broom may include a handle, a broom head having bristles attached to a substrate thereof, a secondary cleaning implement provided in addition to the bristles, an actuator disposed for movement with respect to the handle, the actuator being associated with the secondary cleaning implement such that movement of the actuator with respect to the handle causes the secondary cleaning implement to move downward past the free ends of the plurality of bristles. Of course, the secondary cleaning implement may be any suitable secondary cleaning implement, such as a scraper, abrasive pad or other material or structure.

In still a further aspect of the present invention, the invention is directed to a method of cleaning, including holding a broom having a handle, a broom head with bristles, a bristle plate having openings through which bristles extend, and a bristle plate actuator disposed for movement with respect to the handle. The method could include the actuation of the bristle plate actuator by moving the actuator with respect to the handle of the broom, so that the bristle plate moves downward along the bristles. In accordance with various aspects of the invention, the goal would be to either stiffen the bristles or clean the bristles or to place an optional secondary cleaning implement associated with the bristle plate actuator in better position for cleaning, or perhaps any combination of these. All goals are contemplated in connection with the methods herein, with appropriate steps involved, such as stopping the movement of the bristle plate intermediate the ends of the bristles to stiffen the bristles, continuing the bristle plate so that it is below the free ends of the bristles, or continuing the bristle plate so that it is at a position at which a secondary cleaning implement, perhaps a scraper, can be used more effectively, the position perhaps being below the bristles.

Another step in connection with another aspect of the present invention might include locking the bristle plate actuator at any one of a number of positions, including in a fully protracted position, a fully extended position or positions intermediate thereof.

In another embodiment, the present invention also generally constitutes a hand held broom having an elongated handle. The cleaning head, which is attached to the lower end of the handle, includes a cluster of bristles. One end of the bristles is affixed to the cleaning head, and the opposite end of the bristles is loose and they are used for floor or surface cleaning in the normal manner in which brooms are used. A device, which preferably comprises two parts, joined together to form a housing with tines defines narrow rectangular slots through which the bristles normally extend. The device also preferably comprises a tubular hole through which the handle of the broom passes through, and hence the user can slide this device along the handle upwards and downwards manually. In altering the position of this device with respect to the handle, the length or span of the bristles overhanging from the outer opening of the slots varies. With a shorter span of the overhung bristles, the bristles are stiffer, and become more suitable for heavier brushing action. When the span of the overhung bristles increases, the bristles are not as stiff and appear to be softer, allowing more gentle sweeping action to be carried out.

In yet another embodiment, the present invention also allows the device to slide to a position such that the free ends of the bristles are completely inside the slots or very close to the outer opening of the slots on the device. As there is not much clearance between the slots and the bristles, dirt or dust that is entrapped between the bristles will be pushed away from the bristles, making the bristles clean without the user having to clean the bristles by hand.

In still another embodiment, a scrubbing blade or abrasive pad is also attached to the device such that in the lowest position of the device, the scrubbing blade or abrasive pad is lower than the free ends of the bristles and is thus fully effective in performing scraping or scrubbing action.

Preferably, the device which is invented for adjusting bristle stiffness and cleaning of bristles, can be detained in appropriate position with respect to the handle of the broom either by friction or suitable position detaining mechanism.

DESCRIPTION OF THE PREFERRED EMBODIMENT

Figure 1:
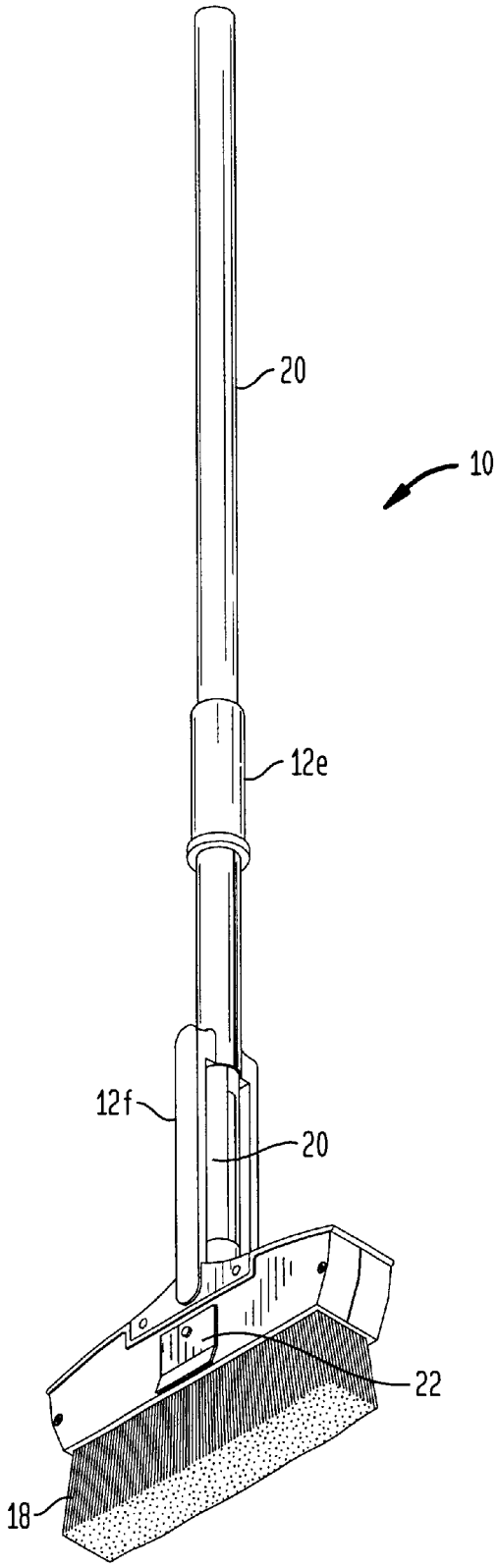
FIG. 1 is a perspective view of a broom in accordance with the present invention.
Figure 2:
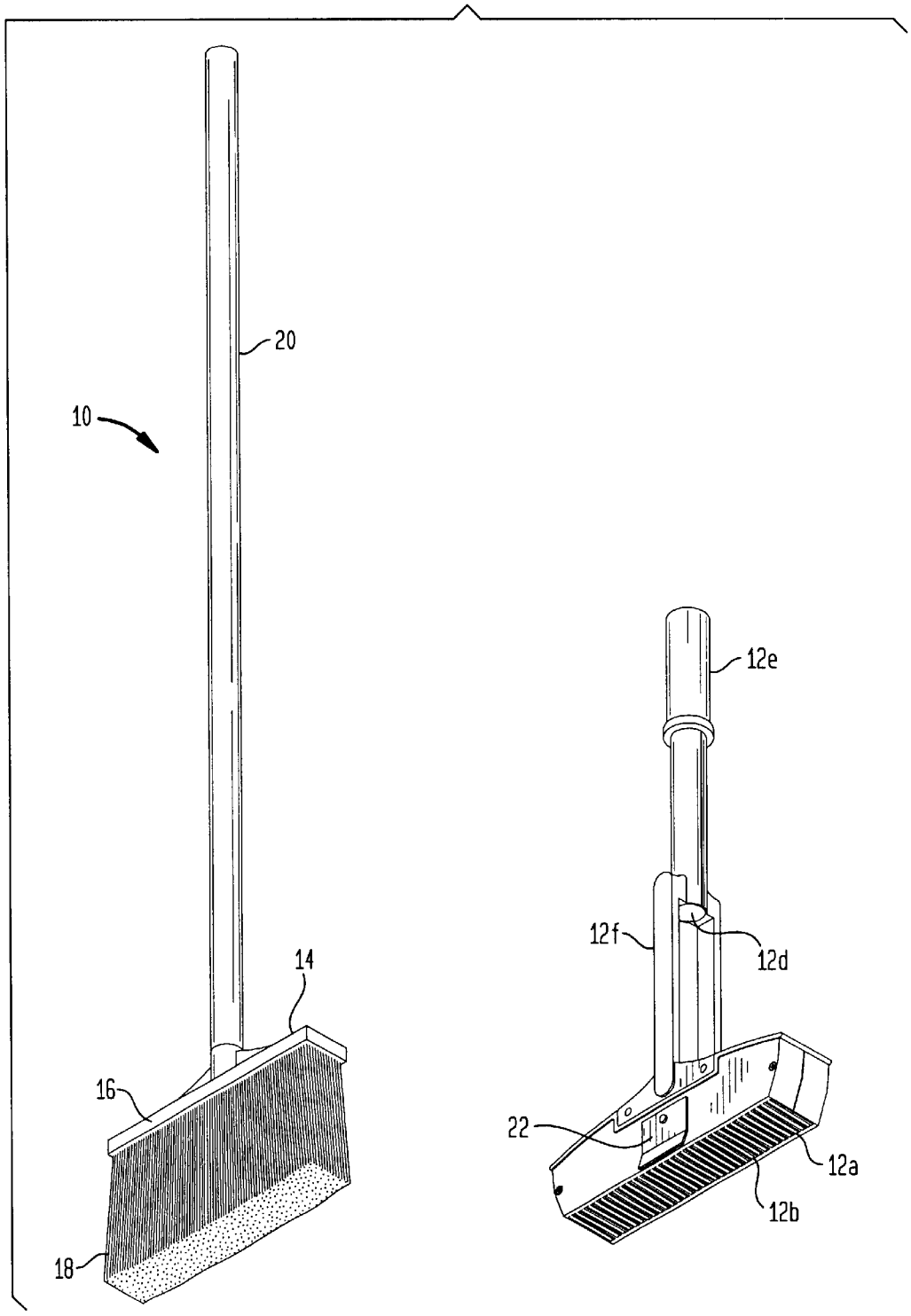
FIG. 2 is a perspective view of the broom in FIG. 1 with the bristle stiffness-adjusting and bristle-cleaning device detached from the broom, illustrating the broom handle and broom head on the left and the stiffness-adjusting and bristle-cleaning device on the right.

FIG. 1 shows a broom, designated as 10 in accordance with the present invention, fully assembled with the bristle stiffness adjusting and cleaning device 12. FIG. 2 shows the device 12 removed from the broom 10 to illustrate the configuration of the broom head 14, which has a substrate 16 and bristles 18. Similar to conventional brooms, the invented broom consists of an elongate handle 20 with the broom head 14 attached firmly to its lower end. The handle 20 may be a two-piece handle by which the two pieces are joined and connected in any suitable manner, such as by a tapered screw connection, a telescoping connection arrangement, a sliding sleeve for stiffening the joint, etc. Bristles 18 made in an appropriate size with a suitable type of material are affixed to the substrate 16 of the broom head 14.

Figure 3:
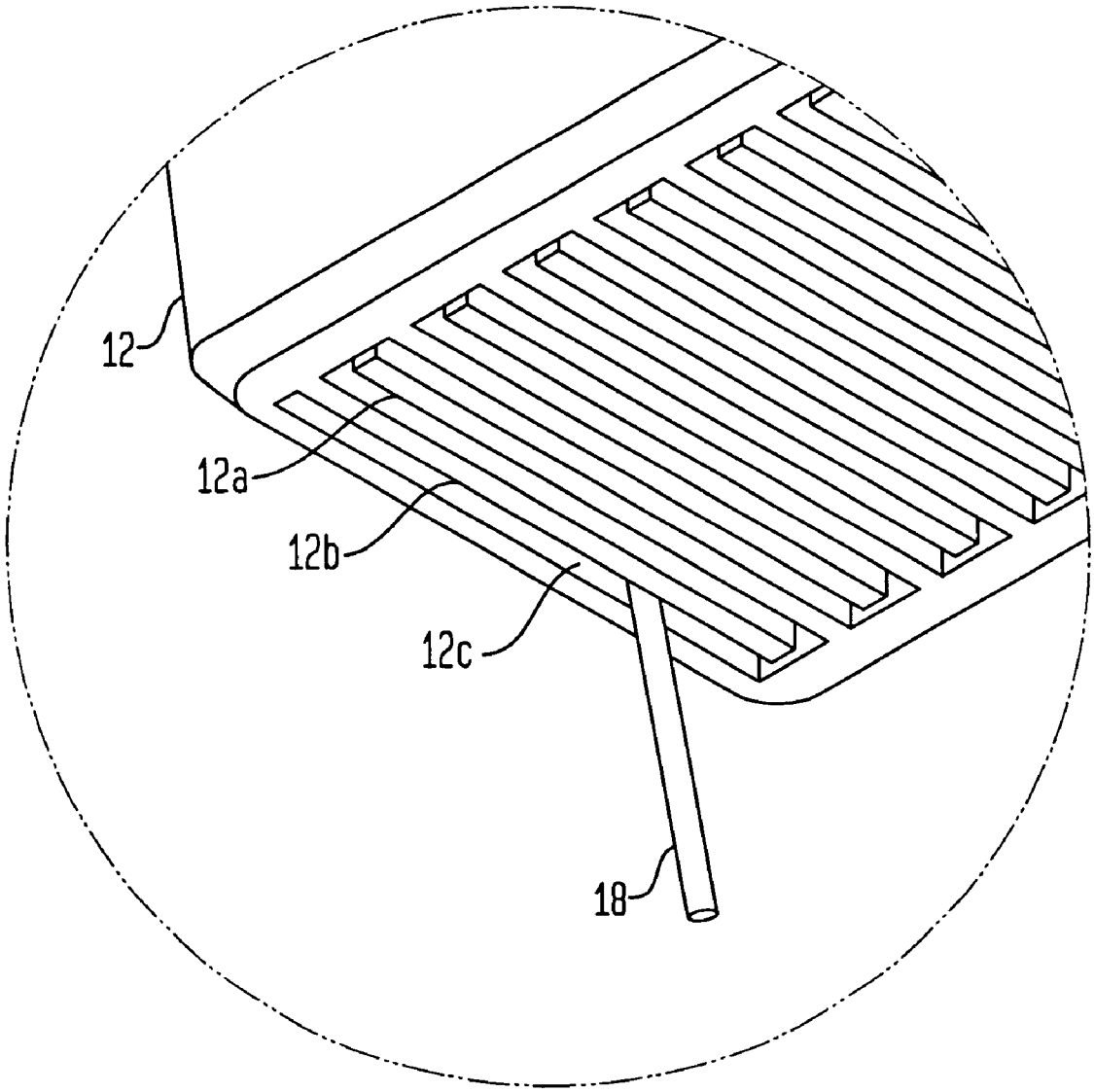
FIG. 3 is an enlarged perspective view of part of the bristle stiffness-adjusting and bristle-cleaning device, illustrating a single bristle threaded through a slot of the bristle plate.

The bristle stiffness adjusting and cleaning device 12, as explained in this embodiment, is made up of two substantially symmetrical plastic pieces, which together define a housing for the broom head 14. Each part of the housing includes tines 12*a* and 12*b* extending towards the opposite part, the tines 12*a* and 12*b* being transverse to the longitudinal axis of the handle 20. When the two housing parts are brought together, the tines 12*a* and 12*b* mesh between one another in a spaced configuration. As illustrated in FIG. 3, when the two housing parts are fixed together, a plurality of parallel slots 12*c* are formed. Preferably, the width of each slot 12*c* is slightly larger than the diameter of each bristle 18 so that the bristle can move freely in and out of the slot. The two parts of the housing also form a boundary, by a wall or rim, that surrounds the plurality of bristles 18. The bristles 18 are, in the preferred embodiment, always surrounded by this boundary and are within the plurality of slots defined by the tines of the housing parts. Of course, the slots may be altered to be openings of any type that would house the plurality of bristles. This would include individual holes for each bristle or for a bunch of bristles, or other types of openings. The tines and the slots between them define a bristle plate which is used to stiffen and to clean the bristles, as part of the stiffness adjusting and cleaning device 12.

As can be seen in the right portion of FIG. 2, the device 12 also includes a tubular hole 12*d*, through which the handle 20 extends and attaches to the housing of device 12. When assembled onto the broom, the device 12 can slide smoothly along the axis of the handle 20. The device 12 also includes a sleeve 12*e*, which may slide up and down the handle 20. Connected between the sleeve 12*e* and the housing are drive members 12*f*, which cause the housing to move downward as the sleeve 12*e* is being moved downward. There can be other variations in the embodiment of the bristle stiffness adjusting and cleaning device 12, such as altering the way that this device is constructed, but the principle of operation of the device would be the same.

Figure 6:
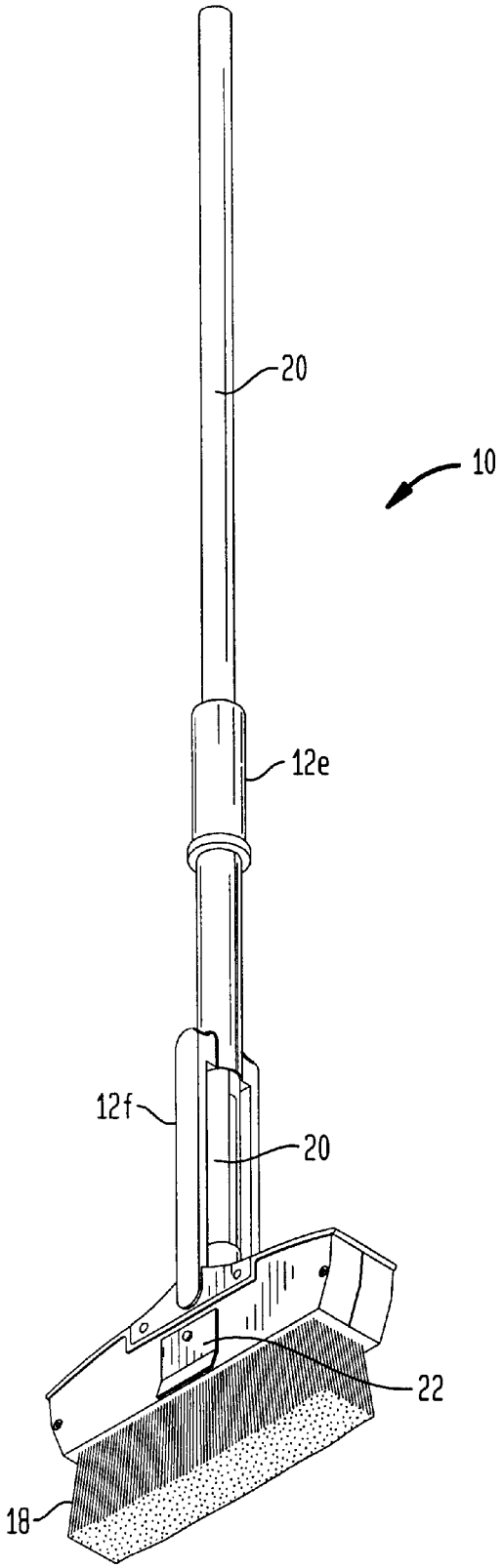
FIG. 6 is a perspective view of the broom with the bristles of the broom extended to a medium overhanging position, where the bristle plate is intermediate the attached and free ends of the bristles.
Figure 7:
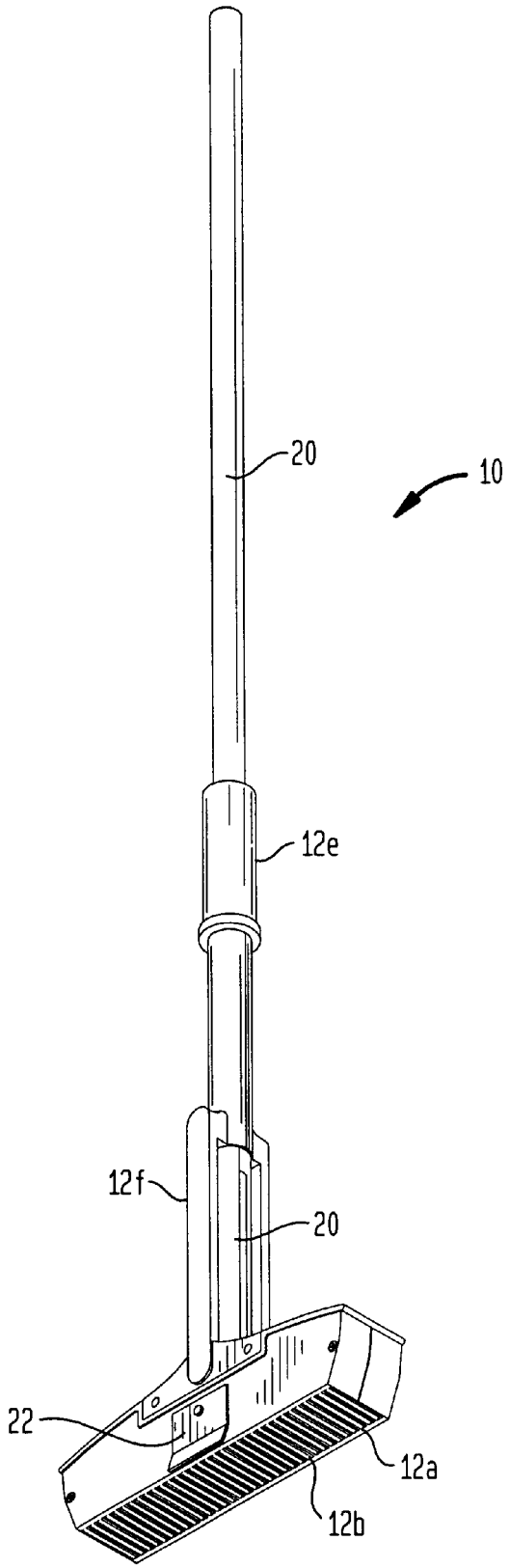
FIG. 7 is a perspective view of the broom with the bristles of the broom fully retracted into the slots of the bristle plate, where the bristle plate is below the free ends of the bristles.

The stiffness adjusting and cleaning device 12 on the broom can be moved to different positions relative to the handle 20 or the head 14 of the broom 10. FIG. 1 shows the broom with the device 12 at a position to enable the bristles 18 to fully extend from the slots 12c. With the overhung span of the bristles 18 adjusted to the maximum value, the bristles are more flexible and appear to be softer, making them more adequate for gentle sweeping work. FIG. 6 shows the broom with the stiffness adjusting and cleaning device 12 set to allow the bristles 18 extending approximately half of the fully extended bristle length from the slots 12*c* on the device 12. When the overhung span of the bristles decreases, the bristles stiffen, making them more suitable to heavier brushing jobs. FIG. 7 shows the broom with the stiffness adjusting and cleaning device 12 set to a position along the handle 20 so that the bristle plate is below the bristles 18. The process of moving device 12 to this position effectively cleans dirt and dust entrapped between the bristles 18 of the broom by the opening edge of the slots 12*c*. As the bristles 18 are bounded by the housing or the bristle plate, the dirt and dust are expelled to the free ends of the bristles. Dirt and dust are not pushed to the sides of the bristles.

When the stiffness adjusting and cleaning device 12 is set to a position as shown in FIG. 7, a scraper blade 22 that is attached onto device 12 becomes more effective as the blade is no longer obstructed by the bristles of the broom. Contamination sticking on the floor can now be scraped off by the blade 22. Other possible arrangements for a secondary cleaning implement such as the blade 22 include other devices with cleaning capabilities, such as tiny brushes or abrasive cleaning pads. Furthermore, an additional scraper blade 22 or another secondary cleaning implement of the same or different types may be arranged on device 12 in addition to the single scraper so that there are two or more scrapers or any combination of two or more secondary cleaning implements on the broom.

Figure 8:
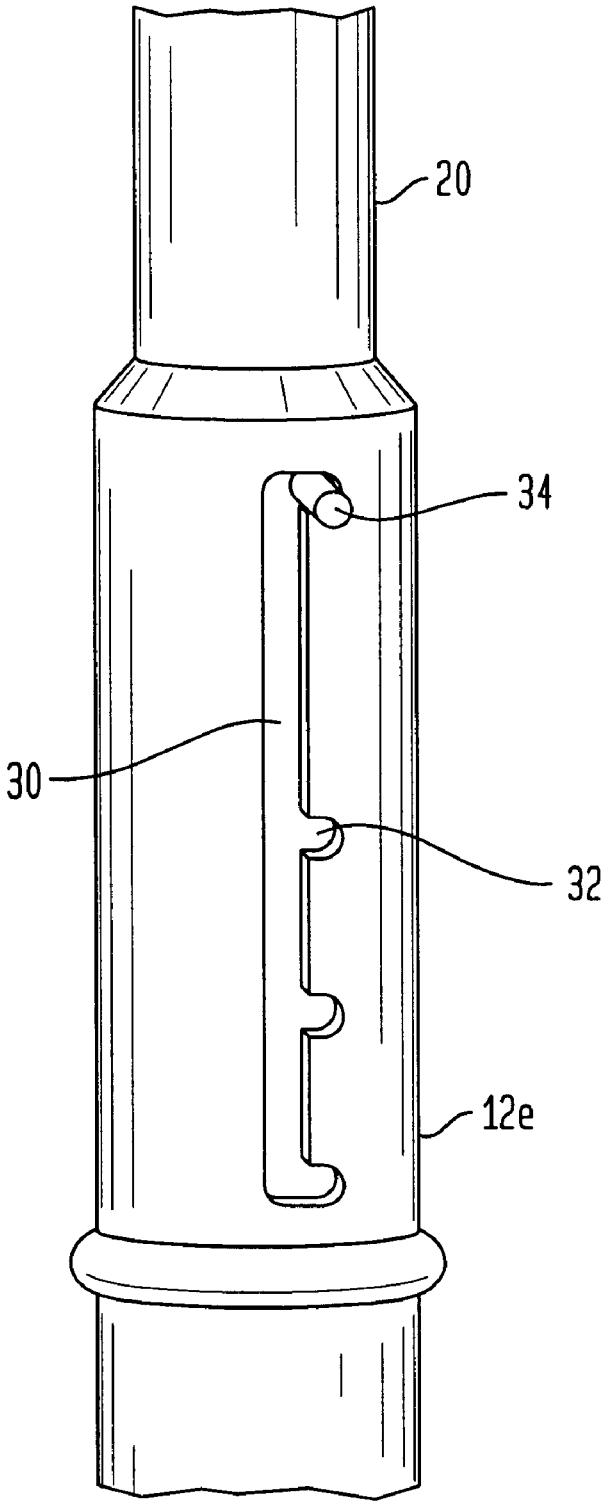
FIG. 8 is an enlarged perspective view of the locking implement of the device, illustrating the slotted sleeve and stop.

There are various means of controlling and detaining the position of the bristle stiffness adjustment and cleaning device 12 on the broom. The device is normally limited to move within its designed end positions. A position locking device may be provided to facilitate locking at various positions. Expedients to accomplish this include friction arrangements or positioning catches. FIG. 8 illustrates a position locking device of the type contemplated by the present invention. Thus, sleeve 12*e* includes a longitudinal slot 30 and four lateral openings 32 that are coextensive with the longitudinal slot 30. A pin 34 is provided in the handle 20, and is stationary with respect to the handle 20. Any suitable stop is contemplated, including a projection screwed or otherwise fastened into the handle 20. In operation, the sleeve 12*e* may be rotated slightly between a locked position, at which the pin 34 is in a lateral opening 32, and a sliding position, at which the pin 34 is in the longitudinal slot 30. The sleeve 12*e*, and thus the device 12, can thus be moved upwards and downwards with respect to the handle 20 when the pin 34 is in the longitudinal slot 30, and then locked at a desired position in the lateral openings 32.

Figure 4:
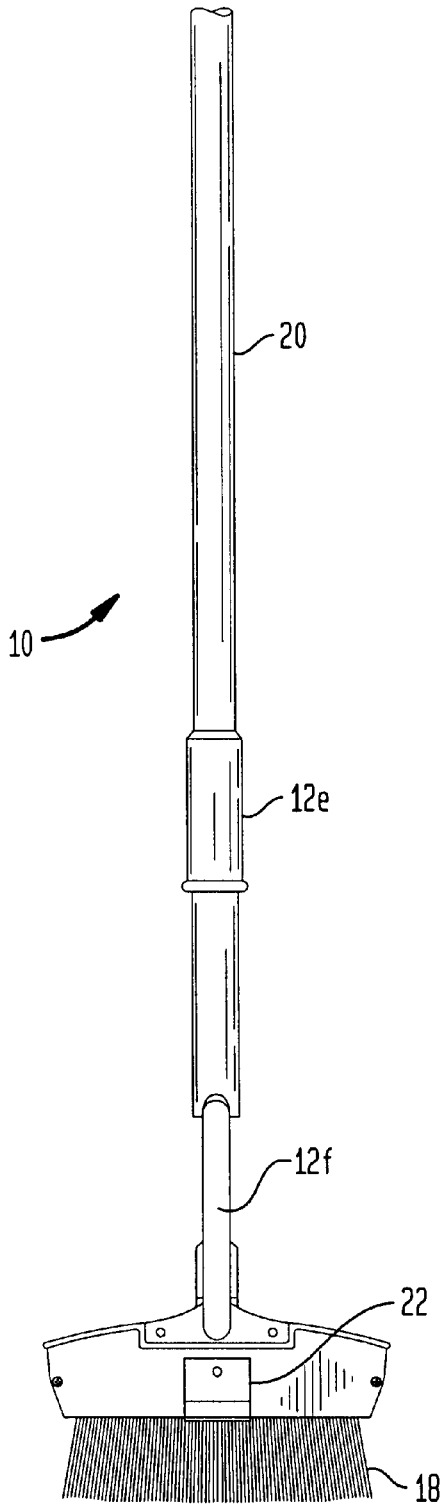
FIG. 4 is a front elevation view of the broom with the bristles of the broom fully extended to a maximum overhanging position, where the bristle plate is adjacent the attached ends of the bristles.
Figure 5:
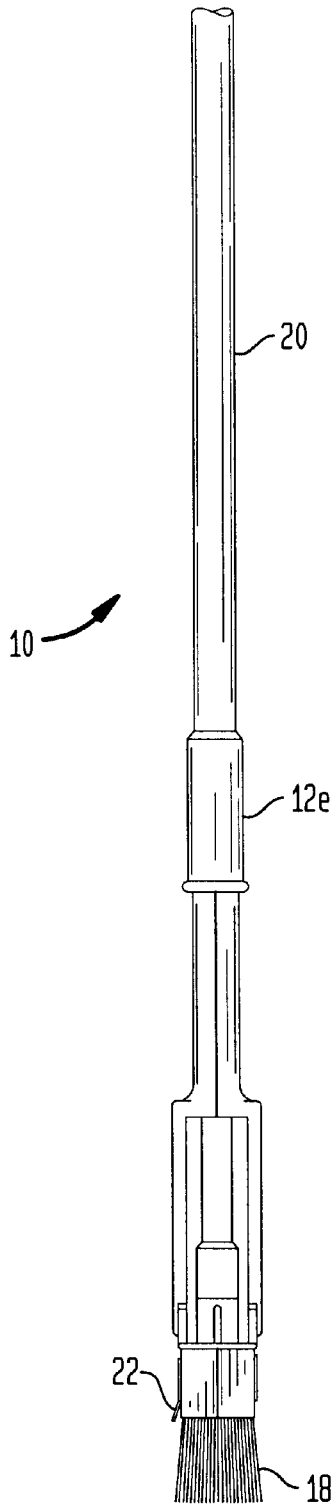
FIG. 5 is a side elevation view of the broom with the bristles of the broom fully extended to a maximum overhanging position.

In FIG. 8, the device is shown in a position at which the sleeve 12*e* and the entire device 12 is in its lowermost position, and is locked in that position. That is the same position shown in FIG. 7 of the drawings. The lowermost position in FIG. 8 is at the level of the lowest lateral stop opening 32, and that is the fully retracted position of device 12, where the bristles 18 are at their longest, as shown in FIG. 4. FIG. 8 also shows two intermediate positions, at which the bristle plate would be locked at points intermediate the attached ends and free ends of the bristles 18. These provide for different levels of stiffness in the bristles.

The method, and its various permutations, in accordance with the present invention, can be gleaned from the above description of the movement and locking of the bristle plate and secondary cleaning implement.

Although the invention herein has been described with reference to particular embodiments, it is to be understood that these embodiments are merely illustrative of the principles and applications of the present invention. It is therefore to be understood that numerous modifications may be made and are encouraged to be made to the illustrative embodiments, and that other arrangements may be devised without departing from the spirit and scope of the present invention as defined by the claims below.

What is claimed is:

1. A broom for cleaning floors or surfaces comprising:

a handle having an upper portion and a lower portion, and a longitudinal axis therebetween;

a broom head at the lower portion of said handle, said broom head having a substrate and a plurality of bristles, each bristle having an end attached to said substrate and a free end for cleaning;

a bristle plate having openings through which bristles can extend;

a bristle plate actuator disposed for movement with respect to said handle, said bristle plate actuator being associated with said bristle plate such that movement of said bristle plate actuator downward along said longitudinal axis of said handle causes said bristle plate to move downward along said plurality of bristles from said attached ends to said free ends;

said bristle plate actuator further including a lock associated with said handle such that said bristle plate can be locked at a point intermediate said attached ends and said free ends of said plurality of bristles.

2. The broom in claim 1, wherein said bristle plate actuator includes a stop associated with said handle such that downward movement of said bristle plate is stopped at a point intermediate said attached ends and said free ends of said plurality of bristles.

3. The broom in claim 1, wherein said bristle plate actuator includes a sleeve around said handle, and wherein said lock comprises a pin fixed in said handle, a longitudinal slot in said sleeve and through which said pin extends, thereby permitting upward and downward movement of said sleeve and said bristle plate actuator, and a lateral opening in said sleeve, said lateral opening being coextensive with said longitudinal slot and said sleeve being rotatable at least to the extent that said pin can be situated in said lateral opening from said slot to lock said bristle plate actuator at a point intermediate said attached ends and said free ends of said plurality of bristles.

4. The broom in claim 3, wherein said sleeve includes two lateral openings in which said pin can be situated upon rotation of said sleeve, and whereby said bristle plate is limited at either of two points intermediate said attached ends and said free ends of said plurality of bristles.

5. The broom in claim 1, further including a secondary cleaning implement associated with the lower portion of said handle.

6. The broom in claim 5, wherein said secondary cleaning implement is associated with said bristle plate actuator such that such secondary cleaning implement moves downward as said bristle plate actuator is moved downward.

7. The broom in claim 5, wherein said secondary cleaning implement is a scraper.

8. The broom in claim 1, wherein said bristle plate actuator can be moved downward such that said bristle plate is moved below the free ends of said plurality of bristles.

9. The broom in claim 8, wherein said bristle plate actuator includes a lock for locking said bristle plate at a point intermediate said attached ends and said free ends of said plurality of bristles.

10. The broom in claim 9, wherein said bristle plate actuator includes locks to permit the bristle plate actuator to be locked so that said bristle plate is at a point adjacent said attached ends of said plurality of bristles, so that said bristle plate is at a point intermediate said attached ends and said free ends of said plurality of bristles, or so that said bristle plate is at a point adjacent said free ends of said plurality of bristles.

11. The broom in claim 8, further including a secondary cleaning implement.

12. The broom in claim 11, wherein said secondary cleaning implement is associated with said bristle plate actuator such that said secondary cleaning implement moves downward with said bristle plate actuator and upon said bristle plate being at the free ends of said plurality of bristles, said secondary cleaning implement extends beyond said free ends of said plurality of bristles.

13. The broom in claim 11, wherein said secondary cleaning implement is a scraper.

14. The broom in claim 1, wherein said openings in said bristle plate are slots that are transverse to said longitudinal axis of said handle.

15. The broom in claim 14, wherein said bristle plate is formed by two halves, each half having tines extending transversely to the longitudinal axis of said handle and meshing with one another in a spaced orientation such that said spaces between said tines form said slots.

16. The broom in claim 15, wherein said bristle plate actuator includes a sleeve surrounding said handle, a two part housing surrounding said substrate of said broom head when said bristle plate is adjacent said attached ends of said plurality of bristles, each housing part carrying said tines of said bristle plate, and at least one drive member connecting said sleeve and said two part housing such that downward movement of said sleeve along said handle moves said two part housing and said bristle plate downward from said attached ends of said plurality of bristles toward said free ends of said plurality of bristles.

17. The broom in claim 1, wherein said bristle plate is normally arranged so that it is adjacent said substrate and said plurality of bristles extend through said openings.

18. A broom for cleaning floors or surfaces comprising:

a handle having an upper portion and a lower portion, and a longitudinal axis therebetween;

a broom head at the lower portion of said handle, said broom head having a substrate and a plurality of bristles, each bristle having an end attached to said substrate and a free end for cleaning;

a bristle plate normally disposed adjacent said substrate, said bristle plate having openings through which said plurality of bristles normally extend;

a bristle plate actuator in constant communication with said handle and disposed for movement along the axis of said handle, said bristle plate actuator being associated with said bristle plate such that downward movement of said bristle plate actuator causes said bristle plate to solely move downward along said plurality of bristles from said attached ends to said free ends to thereby clean said bristles.

19. The broom in claim 18, wherein said openings of said bristle plate are slots bounded by portions of said bristle plate, such that said plurality of bristles are fully bounded within said bristle plate.

20. A broom for cleaning floors or surfaces comprising:

a handle having an upper portion and a lower portion, and a longitudinal axis therebetween;

a broom head at the lower portion of said handle, said broom head having a substrate and a plurality of bristles, each bristle having an end attached to said substrate and a free end for cleaning;

a secondary cleaning implement provided in addition to said plurality of bristles for cleaning floors or surfaces;

an actuator positioned concentric with said handle and disposed for movement with respect to said handle, said actuator being associated with said secondary cleaning implement such that downward movement of said actuator with respect to said handle causes said secondary cleaning implement to move downward past said free ends of said plurality of bristles.

* * * * *